US005915455A

United States Patent [19]

Kittilsen et al.

[11] Patent Number: 5,915,455

[45] Date of Patent: Jun. 29, 1999

[54] APPARATUS, A MOULD AND A STOP PROCEDURE FOR HORIZONTAL DIRECT CHILL CASTING OF LIGHT METALS, ESPECIALLY MAGNESIUM AND MAGNESIUM ALLOYS

[75] Inventors: Bjørn Kittilsen; Bjørn Øiestad, both of Porsgrunn, Norway

[73] Assignee: Norsk Hydro a.s., Olso, Norway

[21] Appl. No.: 08/709,730

[22] Filed: Sep. 9, 1996

[30] Foreign Application Priority Data

Sep. 8, 1995 [NO] Norway ..... 953545

[51] Int. Cl.[6] ..... B22D 11/124

[52] U.S. Cl. ..... 164/440; 164/444

[58] Field of Search ..... 164/487, 486, 164/440, 444, 490

[56] References Cited

U.S. PATENT DOCUMENTS

| | | | |
|---|---|---|---|
| 3,512,574 | 5/1970 | Taylor | 164/487 |
| 3,612,149 | 10/1971 | Rossi | 164/490 |
| 4,071,072 | 1/1978 | McCubbin | 164/487 |
| 4,298,147 | 11/1981 | Honda et al. | 164/440 |
| 4,335,779 | 6/1982 | Morianz | 164/490 |
| 4,732,209 | 3/1988 | Apostolou et al. | 164/487 |

FOREIGN PATENT DOCUMENTS

| | | | |
|---|---|---|---|
| 138802 | 4/1985 | European Pat. Off. | 164/440 |
| 313052 | 4/1989 | European Pat. Off. | 164/440 |
| 813755 | 7/1951 | Germany | 164/444 |
| 56-30064 | 3/1981 | Japan | 164/490 |
| 57-64449 | 4/1982 | Japan | 164/440 |
| 58-119445 | 7/1983 | Japan | 164/487 |
| 59-19057 | 1/1984 | Japan | 164/440 |
| 63-281751 | 11/1988 | Japan | 164/440 |
| 2-63647 | 3/1990 | Japan | 164/487 |
| 770650 | 10/1980 | U.S.S.R. | 164/440 |
| 1119769 | 10/1984 | U.S.S.R. | 164/440 |

*Primary Examiner*—Kuang Y. Lin

*Attorney, Agent, or Firm*—Wenderoth, Lind & Ponack, L.L.P.

[57] ABSTRACT

An apparatus is disclosed for horizontal direct chill casting of light metals, especially magnesium and magnesium alloys. The apparatus includes tundish for containing molten metal and a horizontally disposed mold in communication with the tundish. The mold has a primary cooling circuit for cooling mold walls such that the metal is chilled without any direct contact with the water. Also, a secondary direct cooling circuit is provided. The circuits for primary and secondary cooling water are independent of each other. An insulating transition ring is arranged at the mold entrance. It is important that the total mold depth is short, preferably between 25 and 45 mm. To obtain good surface quality and to avoid discoloring of the metal, it is preferred that the mold has an inlet for supplying protective gas to the transition ring. The inlet opening to the mold should be asymmetrically arranged, nearer the bottom of the mold. It is preferred to use an apparatus where the tundish and mold are separated by a heated inlet which is insulated with material embedded in a steel mantle where the steel is in contact with the molten magnesium. The tundish should have a remote controlled drainage system.

11 Claims, 2 Drawing Sheets

APPARATUS, A MOULD AND A STOP PROCEDURE FOR HORIZONTAL DIRECT CHILL CASTING OF LIGHT METALS, ESPECIALLY MAGNESIUM AND MAGNESIUM ALLOYS

BACKGROUND OF THE INVENTION

The present invention concerns an apparatus, a mold and a stopping procedure for horizontal direct chill casting (HDC) of light metals, especially magnesium and magnesium alloys.

Typically, magnesium and magnesium alloys are cast into ingots or billets and delivered to the customers. The ingots formed often have a poor surface quality. In addition this is not an efficient production method. Vertical direct chill casting of billets provides a product with a high surface quality, but continuous production is not possible because the number of strands are limited. There is therefore a need for a process which provides a high quality product which is free from cracks and shrinkage cavities, and can be cast continuously at a high casting speed.

Horizontal direct chill casting is a method that could fulfil these requirements. This process allows the advantages of multistrand continuous casting and also provides a uniform size of product. However, even though this is proven technology for the casting of aluminum and aluminum alloys, it is not a production method used for magnesium ingots today. Many attempts have been made over the course of several years, but there has been problems finding an apparatus and especially molds that can be used. In addition, when working with a reactive metal such as magnesium, the safety aspect is very important and a safe production process is necessary.

British Patent No. 1 194 224 describes a method of horizontally continuously casting ingots of aluminum and magnesium and their alloys. The apparatus includes a reservoir for molten metal which is separated from the mold by a partial barrier (header plate) which does not chill the mold. The header plate has an opening for passage of the liquid metal therethrough and directly into the chilled mold where the metal is solidified and continuously withdrawn in a horizontal direction. Cooling water is discharged from a chamber in the mold wall through channels for directly cooling the emerging ingot. The mold also has a number of channels for supplying lubricant to a peripheral inner surface of the wall.

The apparatus could be useful for casting aluminum but not for the safe production of cast magnesium and magnesium alloys with a good surface finish. The apparatus has a very wide inlet which would result in difficulties regarding control of the solidification process. The mold depth is too large and the cooling system would cause problems in the case of a run-out of metal.

SUMMARY OF INVENTION

The object of the present invention is to provide a method and an apparatus for horizontal direct chill casting of magnesium and magnesium alloys. The resulting product will be of high quality and produced at a high casting speed. Another object of the present invention is to provide a safe production method and to reduce the consequences of a run-out due to the reactivity of molten magnesium with water.

These and other objects of the present invention are obtained with the method and apparatus as described below.

The present invention concerns an apparatus for horizontal direct chill casting of metal, especially for casting of magnesium or magnesium alloys. The apparatus includes a tundish for holding and maintaining molten metal and a horizontally disposed mold in communication with the tundish. The mold provides primary cooling of the mold walls where the metal is chilled without being in contact with the cooling fluid, such as water. Also, secondary direct cooling of the cast metal is provided. The mold has separate independent circuits for primary and secondary cooling water. An insulating transition ring is arranged at the mold entrance.

It is important that the depth of the mold be short, preferably between 25 and 45 mm. To obtain good surface quality and to avoid discoloring of the metal, it is preferred that the mold has an inlet for a supply of protective gas to the transition ring.

The inlet opening to the mold is asymmetrically arranged, nearer the bottom of the mold. It is preferred to use an apparatus where the tundish and mold are separated by a heated inlet of insulation material embedded in a steel mantle or where the steel is in contact with the molten magnesium. The tundish should have a remote controlled drainage system.

The present invention also concerns a mold to be used for casting of magnesium and magnesium alloys. The mold has primary cooling of the mold walls where the metal is chilled without being in contact with the water. Also, secondary direct cooling of the cast metal is provided. It is essential that the mold has separate independent circuits for primary and secondary cooling water. The mold has an inlet in the form of a transition ring formed of a ceramic material where the inlet opening is asymmetrically situated near the bottom of the mold and where the mold is equipped with a gas supply passage formed in the mold walls for delivering the flow of a supply of protective gas to the transition ring.

It is preferred that the total mold depth be between 25 and 45 mm.

The present invention also includes a stop procedure for direct chill casting of metal, especially magnesium or magnesium alloys. The stop procedure employs casting equipment comprising a melting furnace placed on a lifting table, a heated siphon for supplying molten metal to a tundish, which is in communication with a chilled mold. The mold should have separate primary and secondary cooling systems and a withdrawal system for the cast product. The following steps are automatically carried out to stop the casting when a emergency button is operated.

a. Withdrawal of the product stops.

b. The secondary cooling water to the mold is turned off.

c. A pneumatically operated drainage system is activated and a plug in the tundish is removed and the metal flows into a preheated draining vessel.

d. The valve for the siphon is closed.

e. The siphon is removed from the furnace to stop the supply of metal.

f. The melting furnace is lowered.

BRIEF DESCRIPTION OF THE DRAWINGS

The present invention is further illustrated with reference to drawings FIGS. 1–2, where.

DETAILED DESCRIPTION OF THE INVENTION

Figure 1:
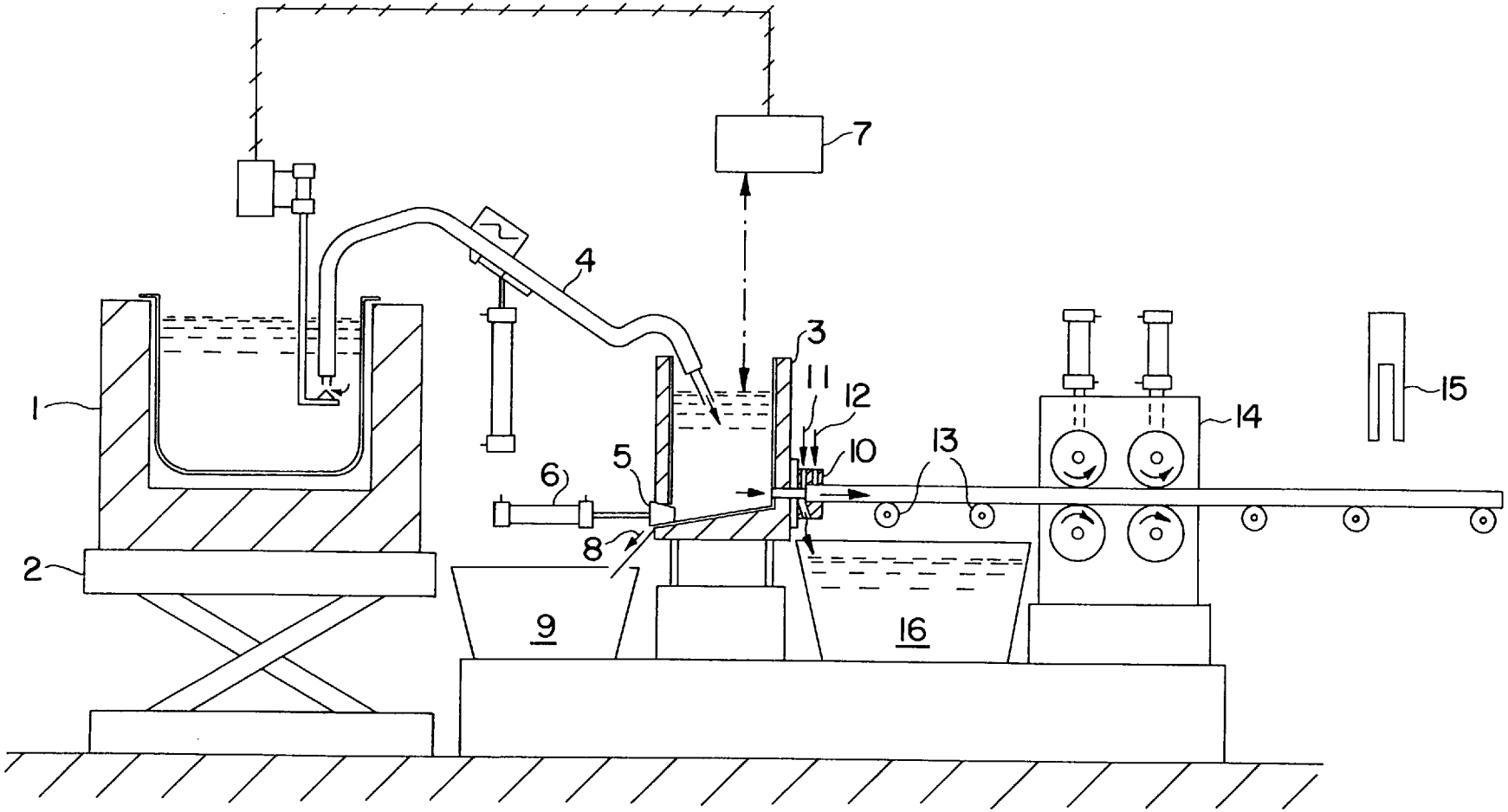
FIG. 1 shows an overview of a casting system constructed in accordance with the present invention.

In FIG. 1 there is shown a melting furnace 1 for magnesium or magnesium alloys. The furnace is placed on a lifting table 2 for lifting or lowering of the furnace. The molten metal is transferred to a heated tundish 3 via a heated siphon 4. The siphon can be lifted and lowered as well. The tundish 3 is formed of steel and has a plug device 5 for a pneumatically operated drainage system 6. The level of metal in the tundish is controlled by a laser level regulator 7.

A drainage vessel 9 is positioned below the drain hole 8 of the tundish. The mold 10 is arranged at the other side of the tundish, and has a primary cooling water circuit 11 and a secondary cooling water circuit 12. The cast metal is supported by rolls 13 and passes further to a withdrawal roll unit 14 before it is cut by a saw 15 into suitable pieces. A vessel 16 for cooling water is placed below the mold. In the case of a run-out, magnesium will run into the water tank.

Figure 2:
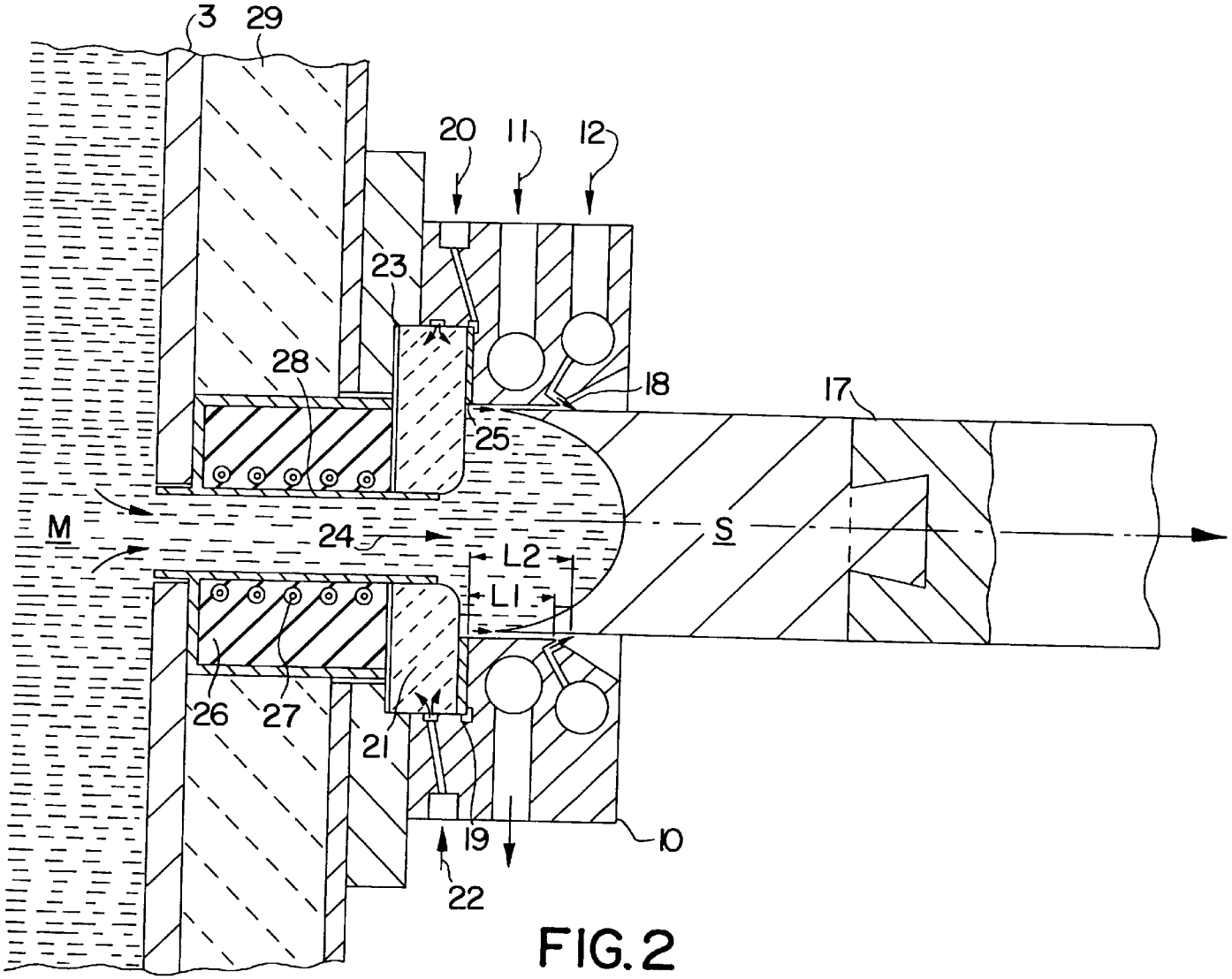
FIG. 2 shows part of a tundish, an inlet and a mold of the casting system.

A starting head 17 for the cast metal is shown in FIG. 2. The mold, an inlet and a part of the tundish are shown in more detail in FIG. 2.

The mold 10, as shown in FIG. 2, is made of for example cooper or aluminum. As previously indicated, the mold has two separate, independent cooling systems. In the primary cooling system 11, water passes through the mold without directly contacting the magnesium. The water from the primary cooling system is led into the vessel 16 below the mold (FIG. 1). The water from the secondary cooling system 12 is sprayed through slots or nozzles 18 directly onto the magnesium for efficient cooling. The water from the secondary cooling system hits the metal with an angle of about 30–35°.

The mold also has an oil ring 19 of metal with channels 20 for supplying oil to lubricate the mold. Reference numeral 21 denotes a transition ring of insulating porous refractory material. Channels or gas supply passages 22 are provided for accommodating the supply of a protective gas as for example $SF_6$. This allows the casting of a smooth ingot without surface discoloration since ingress of air is prevented by the protective gas introduced behind the transition ring.

An inlet 24 to the mold is situated asymmetrically in the mold nearer the bottom of the mold so as to avoid heat convection to the top surface of the ingot. This could result in run-out of the metal. The molten metal M, which will solidify at the point denoted with reference numeral 25 when it enters the mold, will have a thin solidified skin inside of the mold. The letter S illustrates solid metal. The sump (molten metal in the mold) should have its deepest point in the center of the ingot and the total sump should be within the mold. This can be obtained by close to symmetrical cooling. The size of the inlet opening is not critical.

It was found that short molds are required in order to produce ingots at an adequate casting speed with good surface quality. Several molds with different mold depths were tested out before the optimal solution was discovered. The primary mold depth L1, is the distance between the solidification point and the edge of the primary cooling surface, see FIG. 2. The total mold depth L2 is the distance from the solidification point to the hit point for the secondary cooling water. Table 1 shows the different parameters for five different molds.

TABLE 1

| Mold No. | Mold Size (mm) | Primary mold depth, L1 (mm) | Total Mold depth, L2 (mm) |
|---|---|---|---|
| 1 | 140 × 64 | 80 | 150 |
| 2 | 140 × 64 | 80 | 115 |
| 3 | 140 × 64 | 69 | 75 |
| 4 | 140 × 81.5 | 35 | 38 |
| 5 | Ø= 75 | 26 | 28 |

For mold No. 1 the secondary water spray hits the ingot approximately 150 mm away from the point where the metal enters the mold and solidifies. Experimental casting disclosed that the total mold depth was too large and thus, the casting speed low. Remelting inside the mold and run-out of metal occurred. Also the molds 2 and 3 were found to have depths which were too large to obtain optimal casting speeds, while molds No. 4 and 5 gave good results.

Thus, it is important that the mold is designed in such a way that the distance L2, between the point where the secondary water spray hits the metal and the solidification point, is short. Molds with a mold depth L2 between 25 and 45 mm are suitable. To obtain this short distance, the outlet 18 for the secondary cooling water is situated within the mold in the bottom of a conical recess. Further it is essential that the distance L3=L2−L1 is extremely short and preferably below 5 mm.

A critical part of the equipment is the inlet, i.e., the distance between the interior of the tundish 3 and the mold 10. Heat loss and freezing of the metal in the inlet must be avoided. The heat of liquid magnesium passing through the inlet is the only heat source, and the steel parts of the tundish assembly easily extract heat from the melt. Therefore, a good insulating material 26 is required. It was however difficult to find suitable insulation materials that could withstand direct contact with the material. Infiltration of metal into the fiber material, oxidation of magnesium and disintegration of the insulation material caused casting problems after short casting runs. The solution was to embed the insulation material, using a thin-walled steel pipe 28 in order to prevent contact between the insulation material and the magnesium. When using the steel pipe it was found necessary to supply the inlet with heating elements 27 because the steel extracts heat from the liquid metal. It is thus important to be able to control the temperature in the inlet.

The tundish is made of steel. It has a plug device 5 for a pneumatically operated drainage system 6. The tundish is adjustable in all directions in order to facilitate positioning of mold relative to the fixed withdrawal rolls. Also, gas is used to heat the tundish before start-up in order to minimize the preparation time.

Safety is very important when handling a reactive metal like magnesium. The apparatus is therefore designed to take care of this aspect. By start of the process, the starting head 17 is situated within the mold 10. The primary cooling water 11 is turned on. Molten metal is introduced into the mold and will solidify in the orifice of the starting head. The starting head is then withdrawn and the secondary cooling water is first turned on when the outer surface has solidified and stable conditions are obtained. There will therefore not be any contact between the molten metal and water. A low starting speed is used (about 100 mm/min) which is gradually increased.

It is also important to limit the amount of active metal in the event of a run-out. Therefore, the tundish has a limited volume for holding molten metal. We have also found that is essential to separate the primary and secondary cooling systems so as to be able to close the secondary water stream which directly contacts the metal, while still having the capability of cooling the mold in the case of a run-out.

The casting equipment also includes an emergency button and an alarm system. This is used for a controlled stop procedure for the casting process or it is activated in a critical situation. If the emergency button functions rapidly in the right sequence, all propulsion of the metal stops. The secondary cooling water is turned off. The primary cooling water is kept on and escapes from the mold through tubes into the water tank. Thus, there will be no contact with magnesium, while the mold is still cooled. The pneumatic operated drainage system is activated and the plug in the tundish is removed, causing metal to flow into the preheated draining vessel. The valve in the siphon is closed and the siphon is closed and the siphon is removed from the furnace to stop the supply of metal and the furnace is lowered.

EXAMPLES

Horizontal direct chill casting of ingots of pure magnesium and magnesium alloys (AZ91) was carried out using different molds. The mold type and casting conditions are given in Table 2 below.

TABLE 2

| Material to be cast | Mold dimension (mm) | Total mold depth, L2 (mm) | Casting speed (mm/min) | Melt temperature (° C.) | Water Prim./Sec. ($m^{3/h}$) |
|---|---|---|---|---|---|
| Pure Mg | 140 × 64 | 115 | 200 | 706 | 4/5 |
| " | " | 75 | 250 | 707 | 4/5 |
| " | 104 × 81.5 | 38 | 500 | 695 | 3/3 |
| AZ-91 | 140 × 64 | 75 | 175 | 695 | 4/5 |
| AZ-91 | Ø= 75 | 29 | 750 | 665 | 4/4 |

As can be seen from the table, the shortest molds resulted in the highest casting speed and it was possible to safely cast ingots with a good surface finish. The ingots cast in the shortest molds also had a much better surface quality than the others.

We claim:

1. An apparatus for horizontal direct chill casting of magnesium and magnesium alloys, said apparatus comprising:

a tundish having a molten metal outlet;

a horizontally disposed mold in fluid communication with said outlet of said tundish, said mold having mold walls and a mold entrance opening;

an insulating transition ring disposed between said tundish and said mold entrance opening;

a gas inlet passage formed in said mold walls for delivering a protective gas to said insulating transition ring;

a primary fluid cooling circuit formed in said mold walls for cooling metal without directly contacting the magnesium and magnesium alloys with the cooling fluid, wherein said primary cooling fluid circuit is formed such that cooling fluid can be discharged only at a lower portion of said mold; and a secondary fluid cooling circuit formed in said mold walls downstream of said primary cooling circuit, wherein said first and second cooling circuits are independent of each other so that, in case of a runoff, a flow of fluid through said secondary cooling circuit can be turned off while said primary cooling circuit continues to cool said mold.

2. The apparatus for horizontal direct chill casting of magnesium and magnesium alloys as claimed in claim 1, wherein said mold has a total mold depth of between 25 and 45 mm.

3. The apparatus for horizontal direct chill casting of metal as claimed in claim 1, further comprising a drainage device located in a lower portion of said tundish.

4. The apparatus for horizontal direct chill casting of metal as claimed in claim 1, wherein said mold entrance opening is asymmetrically disposed such that said mold entrance opening is located in a lower portion of said mold.

5. The apparatus for horizontal direct chill casting of magnesium and magnesium alloys as claimed in claim 1, further comprising a supply of molten magnesium contained in said tundish.

6. An apparatus for horizontal direct chill casting of magnesium and magnesium alloys, said apparatus comprising:

a tundish having a molten metal outlet;

a horizontally disposed mold in fluid communication with said outlet of said tundish, said mold having mold walls and a mold entrance opening;

an insulating transition ring disposed between said tundish and said mold entrance opening;

a gas inlet passage formed in said mold walls for delivering a protective gas to said insulating transition ring;

a primary fluid cooling circuit formed in said mold walls for cooling metal without directly contacting the magnesium and magnesium alloys with the cooling fluid, wherein said primary cooling fluid circuit is formed such that cooling fluid can be discharged only at a lower portion of said mold;

a secondary fluid cooling circuit formed in said mold walls downstream of said primary cooling circuit, wherein said first and second cooling circuits are independent of each other so that, in case of a runoff, a flow of fluid through said secondary cooling circuit can be turned off while said primary cooling circuit continues to cool said mold;

an insulating material enclosed in a steel pipe which provides fluid communication between said tundish and said mold; and heating elements embedded in said insulating material.

7. A mold for casting magnesium and magnesium alloys, said mold comprising:

a mold body having a mold inlet opening and a central passage extending from said mold inlet opening;

a transition ring formed of ceramic material and disposed at said mold inlet opening, wherein said mold inlet opening is located at a bottom portion of said central passage;

a primary cooling fluid circuit formed in said mold body for cooling magnesium and magnesium alloys without directly contacting the magnesium and magnesium alloys with a cooling fluid, wherein said primary cooling fluid circuit is formed such that cooling fluid can be discharged only at a lower portion of said mold;

a secondary fluid cooling circuit formed in said mold body downstream of said primary circuit, wherein said primary and secondary circuits are independent of each other; and a gas supply passage, formed in said mold body, for supplying a protective gas to said transition ring.

8. The mold as claimed in claimed in claim 7, wherein said secondary fluid cooling circuit includes at least one outlet located in said central passage adjacent a mold outlet opening of said mold body, and said mold outlet opening defines a conical recess.

9. The mold as claimed in claim 8, wherein said primary cooling fluid circuit is formed such that cooling fluid flowing through said primary circuit cannot directly contact the magnesium and magnesium alloys being cast in said mold.

10. The mold as claimed in claim 9, wherein said secondary cooling fluid circuit is formed such that cooling fluid flowing through said secondary circuit will directly contact the magnesium and magnesium alloys being cast in said mold.

11. The mold as claimed in claim 8, wherein said mold has a total mold depth of between 25 and 45 mm.

* * * * *